United States Patent [19]

Nakayama et al.

[11] Patent Number: 4,797,167

[45] Date of Patent: Jan. 10, 1989

[54] METHOD FOR THE PRODUCTION OF ORIENTED SILICON STEEL SHEET HAVING EXCELLENT MAGNETIC PROPERTIES

[75] Inventors: Hisanobu Nakayama; Shouzaburo Nakashima; Yoshiaki Shimoyama; Yasukazu Mori, all of Kitakyushu, Japan

[73] Assignee: Nippon Steel Corporation, Tokyo, Japan

[21] Appl. No.: 881,834

[22] Filed: Jul. 2, 1986

[51] Int. Cl.[4] ..... H01E 1/04

[52] U.S. Cl. ..... 148/111; 148/112

[58] Field of Search ..... 148/110, 111, 112

[56] References Cited

U.S. PATENT DOCUMENTS

| | | | |
|---|---|---|---|
| 1,965,559 | 7/1934 | Goss | 148/111 |
| 3,287,183 | 11/1966 | Taguchi et al. | 148/111 |
| 3,636,579 | 1/1972 | Sakakura et al. | 148/111 |
| 3,959,033 | 5/1976 | Barisoni et al. | 148/111 |
| 4,014,717 | 3/1977 | Barisoni et al. | 148/111 |
| 4,118,255 | 10/1978 | Barisoni et al. | 148/111 |
| 4,123,298 | 10/1978 | Kohler et al. | 148/111 |
| 4,319,936 | 3/1982 | Dahlstrom et al. | 148/111 |
| 4,563,226 | 1/1986 | Matsuo et al. | 148/111 |

FOREIGN PATENT DOCUMENTS

| | | |
|---|---|---|
| 52-94825 | 8/1977 | Japan . |
| 58-23407 | 2/1983 | Japan . |
| 58-42727 | 3/1983 | Japan . |

*Primary Examiner*—John P. Sheehan

*Attorney, Agent, or Firm*—Wenderoth, Lind & Ponack

[57] ABSTRACT

Method for the production of a single oriented silicon steel sheet having excellent magnetic property which comprises providing a silicon steel slab containing 0.010~0.10% C, 2.5~4.5% Si, 0.02~0.15% Mn, and a total of 0.008~0.080% of one or two of S and Se, hot rolling the silicon steel slabing to sheet, and subjecting the hot rolled sheet to a two-step annealing procedure wherein the first half is at a temperature of 1000°~1200° C. and the latter half at 750°~980° C., and to at least two cold rolling steps.

1 Claim, 3 Drawing Sheets

METHOD FOR THE PRODUCTION OF ORIENTED SILICON STEEL SHEET HAVING EXCELLENT MAGNETIC PROPERTIES

BACKGROUND OF THE INVENTION

1. Field of the Invention

The present invention relates to a method for the production of single-oriented silicon steel sheet having low core loss.

2. Description of the Prior Art

Single-oriented silicon steel sheet (hereinafter referred to as oriented silicon steel) is used as nonpermanent magnetic material intended chiefly for the iron cores of transformers and other electric equipment and devices. It is required that the oriented silicon steel have a good magnetic flux density $B_{10}$ value (the magnetic flux density in the rolling direction generated at a magnetic intensity of 1000 A/m) as the excitation property, and good core loss in $W_{17/50}$ and $W_{15/50}$ values (at an alternating current of 50 Hz, the core loss at a magnetic flux density of 1.7 T and 1.5 T).

Recently, with the rapid rise of energy costs, in order to conserve energy and resources, there has been strong demand for transformers and other electrical equipment with lower electrical power loss and higher efficiency.

Accordingly, there has been strong demand for oriented silicon steel core materials with better core loss.

The prior art relating to the improvement of the magnetic properties of oriented silicon steel discloses a method whereby a fundamental chemical composition of silicon steel contains mainly MnS or MnSe for the precipitation dispersion phase, and the silicon steel is subjected to two or more cold rolling steps including an intermediate annealing, as follows:

Japan Kokai Koho (Published Unexamined Patent Application referred to as Kokai hereinafter) 58(1983)-42727 discloses a fundamental composition containing 0.02~0.2% Cu, and attempting optimum of the precipitation dispersion phase by controlling the hot rolling temperature in order to improve the magnetic property.

Kokai 58(1983)-23407 discloses a fundamental composition containing 0.005~0.035% Sb and 0.04~0.18% Cu to attain a fine precipitation dispersion phase, and better magnetic properties are obtained by controlling the temperature of the intermediate annealing.

Kokai 52(1977)-94825 discloses that better magnetic properties are obtained by controlling the cooling rate of the intermediate annealing, and carrying out the aging in the final cold rolling process.

In the above prior art, magnetic properties are improved by altering to the chemical composition of the steel, by controlling the temperature of the intermediate annealing and the cooling rate, and by aging the steel in the cold rolling process, but the core loss value is still 1.08~1.39 w/kg (0.30 mm thick) at $W_{17/50}$. Thus while core loss is reduced compared with previous methods, it is still not fully satisfactory, and there are still problems regarding the stable production thereof.

And Ser. No. 381,877 discloses a method for producing a single oriented electric magnetic steel sheet of a high magnetic flux density as follows: a silicon steel slab containing 2.5~4.0% Si, less than 0.085% C, 0.010~0.050% acid-soluble Al, 0.03~0.15% Mn, and 0.010~0.050% S is subjected to a hot rolling, to a precipitation annealing, to more than one final cold rolling in the range of a reduction 81~95% to produce a sheet with the final thickness, to a decarburizing, and finally to a finish annealing. In the above method, the precipitation annealing comprises heating the steel to a specified temperature in the range of a soaking temperature from 800° C. to 1080°~1200° C. at a rate of 2°-10° C./sec, holding it at the specified within 60 seconds, and thereafter cooling it. The cooling time is determined for 20~500 seconds till the steel reaches a specified temperature in the range of 900°~980° C., then it is quickly cooled from the specified temperature to room temperature at a rate of more than 10° C./sec.

A characteristic feature of the above invention consists in the following: a silicon steel containing 0.010~0.050% acid-soluble Al is subjected to an annealing immediately prior to the final cold rolling at a soaking temperature in the range of 1080°~1200° C., and the final cold rolling is carried out with a reduction of 81~95%. Further, in the annealing prior to the final cold rolling, the steel is heated to a temperature above 800° C. with a heating rate of 2°~10° C./sec. During the annealing course, it is seen that $Si_3N_4$ precipitated in the hot rolled steel sheet is decomposed while AlN is precipitated into an optimum size thereof.

In addition, the precipitated compound is prevented from growing too coarse by specifying the soaking time within 60 seconds, and a sufficient precipitation is realized by controlling the cooling from the soaking temperature to the 900°~980° C., and subsequently it is quickly cooled to room temperature.

According to the method of U.S. Pat. No. 3,636,579, it is not always easy to obtain excellent magnetic properties by the variation of the AlN size after the precipitation annealing in accordance with the content of Al of the steel.

The above invention therefore proposed precipitation conditions for the formation of an optimum AlN hardly affected by the composition of a steel by an improvement of the annealing condition immediately prior to the final cold rolling.

SUMMARY OF THE INVENTION

It is an object of the present invention to provide a method for the production of an oriented silicon steel having an excellent core loss value.

BRIEF DESCRIPTION OF THE DRAWINGS

Other and further objects of the invention will become apparent to those skilled in the art from the following detailed description with reference to the accompanying drawings in which.

DETAILED DESCRIPTION OF THE INVENTION

The inventors of the present invention have carefully studied a method for greatly improving the magnetic property of oriented silicon steel with a steel containing less than 0.1% C, 2.5~4.5% Si, 0.02~0.15% Mn, and also a total of 0.008~0.080% of S or Se or both as the fundamental composition, and which is cold-rolled at least twice.

Particular attention was paid to the annealing step of the hot rolled sheet, and the relation between various conditions of steps and magnetic properties were investigated in detail.

As a result, it was found that both magnetic flux density and core loss are improved while the grain size of the secondary recrystallization is decreased as the annealing temperature of the hot rolled sheet is increased. However, if this temperature is made too high, it was found that stable secondary recrystallization cannot be obtained, fine grains being produced and satisfactory magnetic properties are not obtainable.

As a result of further experimentation, it was found that stable secondary recrystallization with fine grain size could be attained by using a two-stage annealing heat cycle, where the first is maintained at a high temperature and the second half is a temperature that is lower than that of the first half, and that this provided a great improvement in magnetic property, compared with the prior art.

Figure 1:
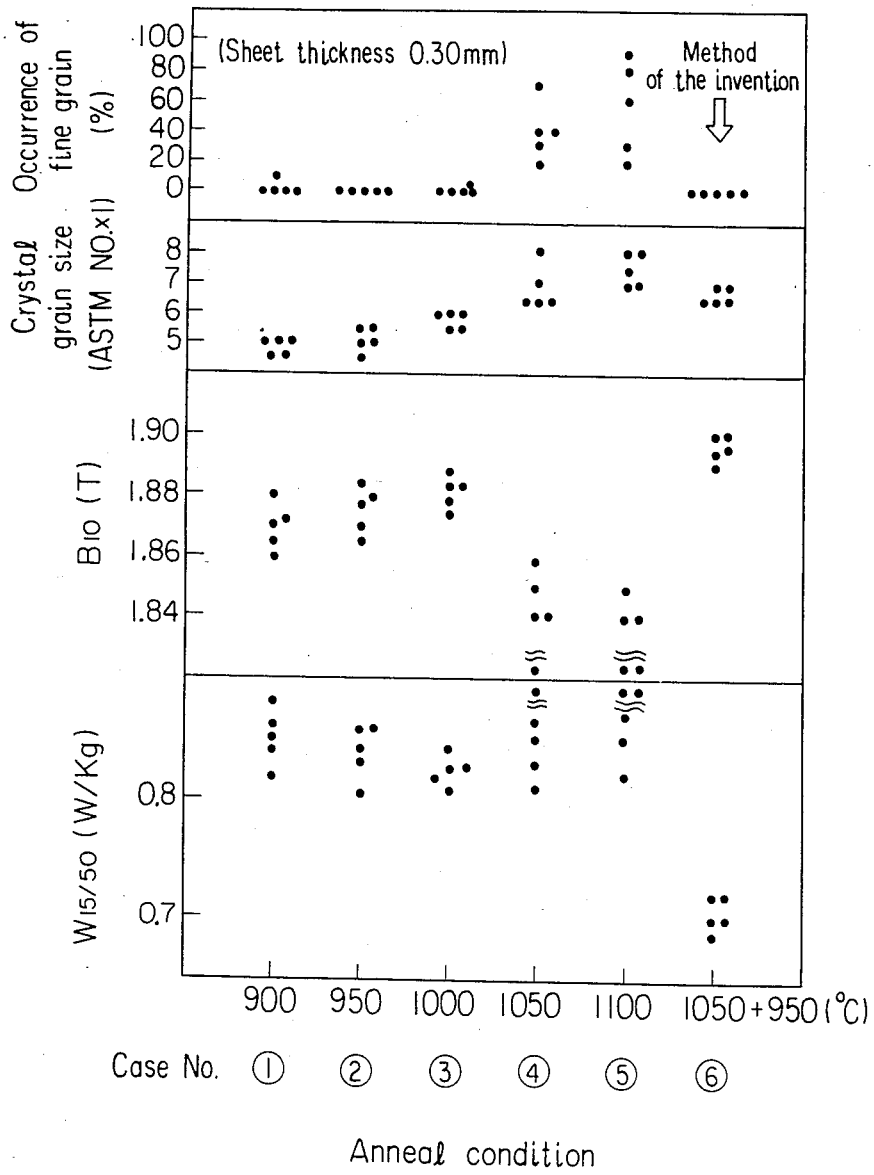
FIG. 1 is a graph showing core loss value $W_{15/50}$, magnetic flux density $B_{10}$, grain size, indicated as an ASTM (X1), and the occurrence of fine grains of annealed hot rolled sheet.

FIG. 1 shows the core loss value $W_{15/50}$, magnetic flux density $B_{10}$, grain size, and rate of occurrence of the fine grains (which is an indicator of the stability of the secondary recrystallization) under the six different annealing conditions.

The material used for the experiments was hot rolled silicon steel sheet 2.5 mm thick containing 0.050% C, 3.2% Si, 0.060% Mn, 0.027% S and 0.15% Cu produced by a normal steel-making process and the use of continuous casting, and hot rolling.

The cases (1)~(5) show the annealing of the hot rolled sheet according to the single heat cycle of the prior art. The single heat cycle comprises heating the steel to a temperature of 1100° C. from 900° C. in steps of 50° C., and maintaining it for two minutes.

The case (6) refers to the method of the present invention in which the first half of the heat cycle comprises heating the steel sheet to a temperature of 1050° C. within 60 seconds, maintaining it for 30 seconds, cooling it to 950° C., and maintaining it at 950° C. for one minute.

Figure 2:
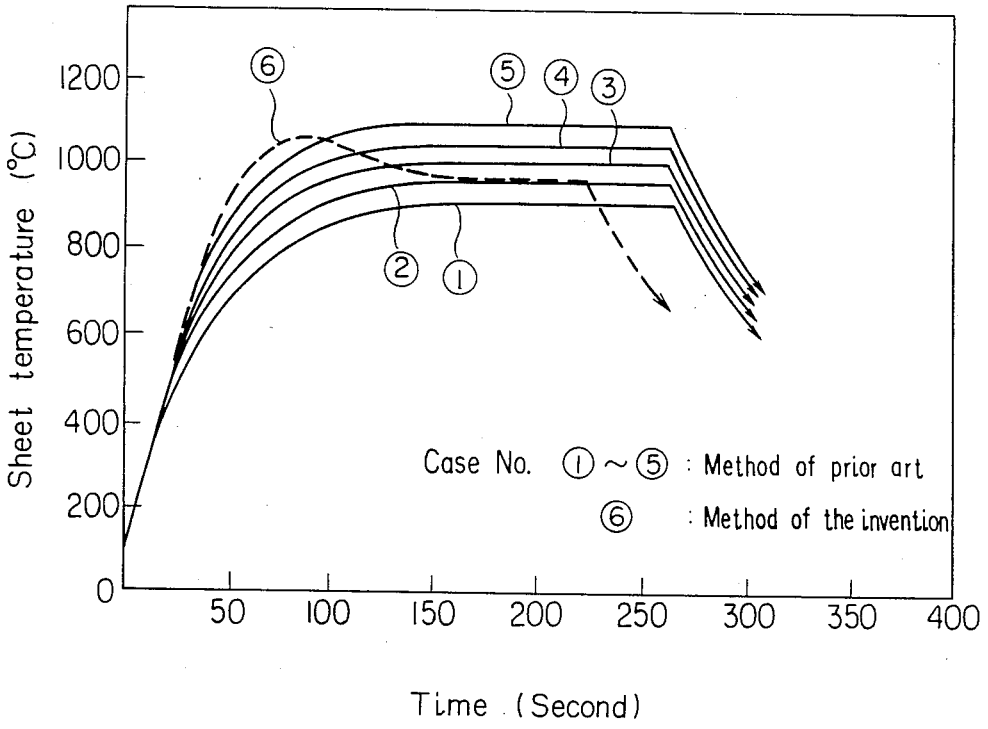
FIG. 2 is a graph showing the temperature cycle at the annealing of the hot rolled sheet.

FIG. 2 illustrates the changes in the temperature of the steel sheet at each point of time for each case.

After the annealing of the hot rolled sheet, the sheet is subjected to two cold rolling steps with an intermediate annealing therebetween to produce the final 0.30 mm sheet. The final sheet is then finished by subjecting it to decarburizing annealing, coating with an annealing separating agent, and the finish annealing.

As a result, as shown in FIG. 1, it is seen that in the cases (1)~(5) the grain tends to become smaller as the temperature rises, both $W_{15/50}$ and $B_{10}$ tending to improve; but a fine grains begin to appear at about 1050° C., and secondary recrystallization becomes so unstable that both $B_{10}$ and $W_{15/50}$ start to deteriorate, and at 1100° C. this becomes marked.

On the other hand, however, it can be clearly seen that in the case (6) the recrystallization is stable, the grain size is small, and both $W_{15/50}$ and $B_{10}$ are improved considerably, compared with the prior art.

The reason for the limitation on each of the constituent conditions of the present invention will now be described, starting with the chemical constituents of the silicon steel of the present invention.

Carbon is a component required to separate and break down coarse grains that develop in the high temperature heating step of the silicon steel slab by the formation of more than a specified amount of the Y phase in the range of temperature specified for the hot rolling procedure. If it is 0.010% or less, the requisite amount of Y phase is not assured, while if on the other hand it exceeds 0.10%, the decarburization prior to the final annealing is so difficult that a long period is required for the decarburizing annealing, and hence it is not economical. Accordingly, the specified amount of C is 0.010~0.10%.

Silicon is an element that is essential for reducing core loss by increasing the specific resistance. If there is less than 2.5% Si, sufficiently low core loss cannot be obtained, while if on the other hand it exceeds 4.5%, the steel becomes highly embrittled, adversely affecting the cold workability and making the usual industrial rolling very hard to perform. Thus, the amount of Si is limited to the range of 2.5–4.5%.

The elements Mn, S and Se are required as inhibitors in secondary recrystallization to achieve full grain development of secondary recrystallization in the (110) [001] orientation by inhibiting the development of undesirable grains in the primary recrystallization of other than the (110) [001] orientation. Regarding Mn, S and Se, the amount of Mn should be in the range of 0.02~0.15%, and the amount of S or Se or S and Se should be kept to 0.008~0.080%. If the above ranges are deviated from, the inhibition effect will not be attained.

In addition to the above essential components, other elements, such as As, Bi, Cu, Sb, Sn, Cr, Ni, B, Nb, Mo, V, Pb, Te, and W known to be directly or indirectly effective as inhibitors can be added as required singly or in combination with the total amount of less than 0.25% in order to attain the object of the present invention.

The annealing conditions with respect to the hot rolled silicon steel sheet will now be explained.

Figure 3:
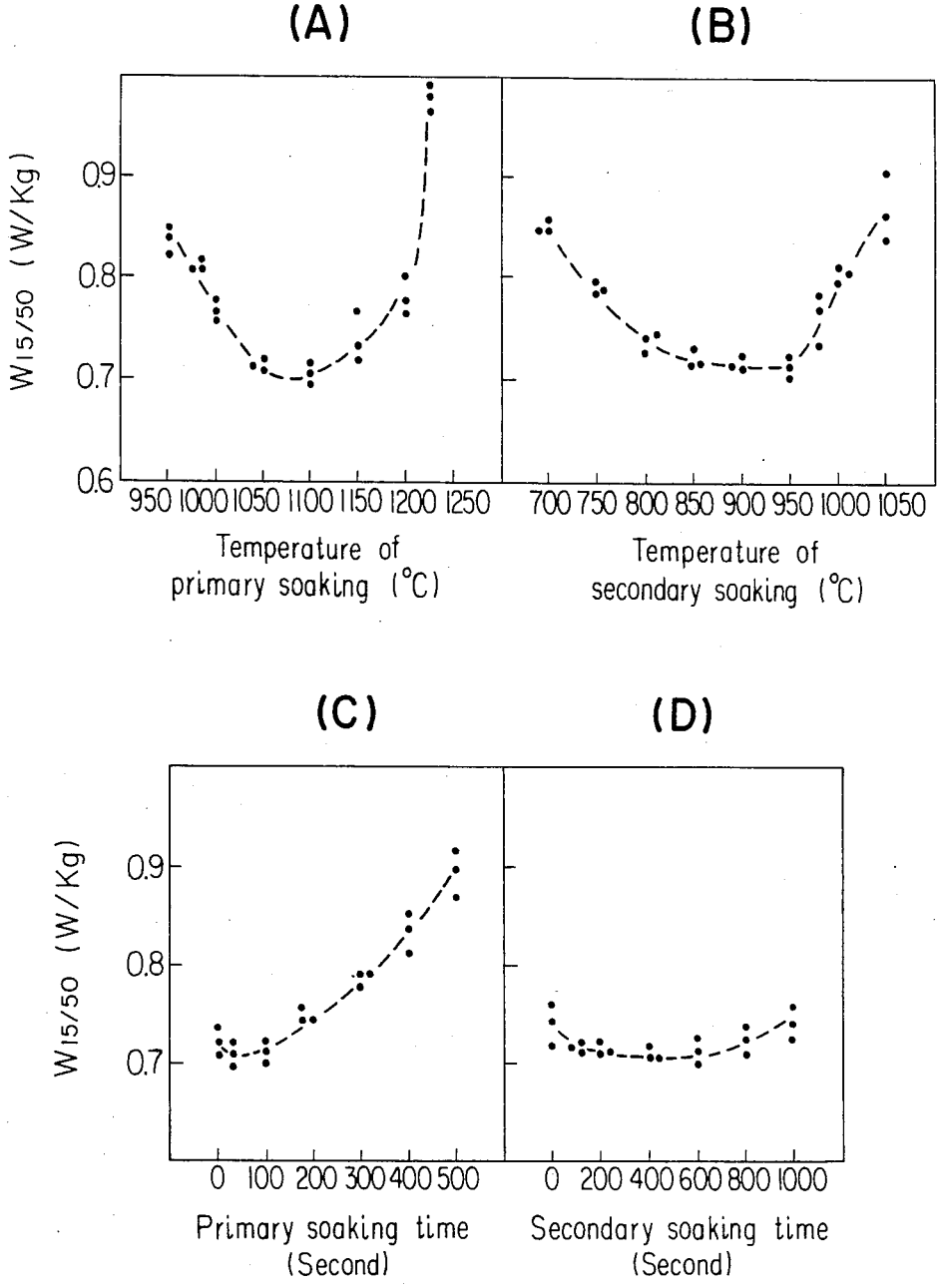
FIGS. 3A to 3D is a set of graphs showing the relation between the temperature and time, and the core loss value $W_{15/50}$ of the annealed hot rolled sheet of the invention.

FIG. 3 is a graph showing the results of the inventors' experiments in connection with the influence of temperature and time on the core loss value ($W_{15/50}$) of the two-step heating cycle according to the present invention.

The sample material used for the experiment is the same hot rolled silicon steel sheet used for the experiment of FIG. 1.

The conditions for processes other than the annealing of the hot rolled silicon steel sheet are as follows. After a first cold rolling step, an intermediate annealing is carried out using a known process, and the silicon steel sheet is then subjected to final cold rolling step to produce sheet 0.30 mm thick, which is then subjected to a known decarburizing annealing, coating with an annealing separating agent, and finish annealing, to produce the final product.

The reason for the two-step heat cycle condition of the invention will now be described based on the results of experiments.

FIG. 3-A shows the results of an experiment in which the initial half soaking (referred to as the primary soaking hereinafter) for the annealing of the hot rolled sheet lasted 30 seconds, and the second half soaking (referred to as the secondary soaking hereinafter) lasted 180 seconds at a temperature of 950° C., (both the time and temperature are specified), and the primary soaking was varied within the range of 950° C.~1240° C.

As clearly indicated in FIG. 3-A, an excellent $W_{15/50}$ value is obtained in a primary soaking range of 1000°~1200° C., hence the primary soaking temperature range is specified as 1000°~1200° C.

FIG. 3-B shows the results of an experiment in which primary soaking temperature was 1050° C., the soaking time 30 seconds, and secondary soaking time 180 seconds, and the secondary soaking temperature was varied within the range of 700°~1050° C.

As shown in FIG. 3-B, an excellent $W_{15/50}$ value was obtained in the range of 750°-980° C., and accordingly, the specified secondary soaking temperature range is 750°~980° C.

FIG. 3-C shows the results of an experiment in which the primary soaking temperature was 1050° C., the secondary soaking temperature 950° C., the soaking time 180 seconds, and the primary soaking time was varied within the range of 0~500 seconds. As indicated in FIG. 3-C, an excellent $W_{15/50}$ value was obtained within 300 seconds of the primary soaking. Hence a primary soaking time of within 300 seconds, and including zero seconds, is specified.

FIG. 3-D shows the results of an experiment in which the primary soaking temperature was 1050° C., the soaking time 30 seconds, the secondary soaking temperature 950° C., and the secondary soaking time was varied within the range of 0-1000 seconds. As shown in FIG. 3-D, an excellent $W_{15/50}$ value was obtained overall, but a time that exceeds 600 seconds is undesirable in view of commercial productivity requirements. Therefore a secondary soaking time of within 600 seconds, which includes zero seconds, is specified.

The steel of the present invention does not contain more than an unavoidable amount of acid-soluble Al. The unavoidable amount of acid-soluble Al is nearly less than 30 PPM. In the method of the present invention, MnS and MnSe are utilized as an inhibitor, but AlN is not.

In accordance with the present invention, the annealing does not refer to the one immediately prior to the final cold rolling, but refers to the one of the hot rolled steel sheet in the process including more than two steps of the cold rolling with an intermediate annealing.

The present invention has nothing to do with the precipitation of AlN, and the control of the temperature rising rate in the annealing is not required. The reduction of the final cold rolling of the invention is 40~80%.

EXAMPLE 1

Steel containing 0.048% C, 3.15% Si, 0.060% Mn, 0.005% P, and 0.026% S was prepared by a usual method of steel melting, continuous casting, and hot rolling to produce hot rolled silicon steel sheet 2.3 mm thick. The hot rolled steel sheet was subjected to annealing under the following conditions (1) and (2).

(1) The method of this invention: the hot rolled sheet was charged into a furnace where the temperature was 1070° C., and when the temperature of the sheet reached 1050° C., the sheet was immediately charged into a furnace where the temperature was 950° C. When the sheet temperature reached 950° C., the sheet was immediately subjected to a rapid cooling.

(2) The method of the prior art: the hot rolled sheet was charged into a furnace where the temperature was 950° C., kept at this temperature for two minutes, and then rapidly cooled.

Subsequently, the above hot rolled sheets were subjected to the treatment indicated in Table 1 to produce a final product 0.30 mm thick with the magnetic property shown in Table 2.

As clearly shown in Table 2, the product produced by the method of the present invention has better magnetic properties than the conventional product of the prior art.

TABLE 1

| Primary cold rolling | Intermediate annealing | Final cold rolling | Decarburizing annealing | Annealing separating agent | Finish annealing |
|---|---|---|---|---|---|
| thickness 2.30 mm ↓ thickness 0.80 mm | 980° C. × min. | thickness 0.80 mm ↓ thickness 0.30 mm | 850° C. × 200 sec. $N_2 + H_2$ wet | MgO | 1200° C. × 20 hr |

TABLE 2

| Hot rolled sheet annealing method | $B_{10}$(T) | $W_{15/50}$ (w/kg) | $W_{17/50}$ (w/kg) |
|---|---|---|---|
| (1) Method of this invention | 1.87 | 0.77 | 1.14 |
| (2) Method of the prior art | 1.85 | 0.86 | 1.21 |

EXAMPLE 2

Steel containing 0.045% C, 3.25% Si, 0.058% Mn, 0.005% P, 0.027% S, and 0.15% Cu was prepared by a usual method of steel melting, continuous casting, and hot rolling to produce hot rolled steel sheet 2.5 mm thick. The hot rolled silicon steel sheet was subjected to annealing under the following conditions (3), (4), (5) and (6).

(3) The method of this invention: the hot rolled sheet was rapidly heated from room temperature to 1050° C., and held at 1050° C. for one minute. It was then cooled to 950° C., kept at that temperature for two minutes, and then quickly cooled.

(4) The method of this invention: the hot rolled sheet was rapidly heated from room temperature to 1100° C.; when the sheet reached 1100° C. it was immediately charged into a furnace where the temperature was 920° C. and was held at this temperature for two minutes, and was then rapidly cooled.

(5) The method of the prior art: the hot rolled sheet was charged into a furnace where the temperature was 980° C. where it remained for five minutes, and was then quickly cooled.

(6) The method of the prior art: the hot rolled sheet was charged into a furnace where the temperature was 1100° C., kept there for five minutes, and then rapidly cooled.

Subsequently, the sheet was subjected to the treatment indicated in Table 1 to produce a final product 0.30 mm thick which had the magnetic property shown in Table 3. It can be seen that the product manufactured by the method of the present invention has better magnetic property than the product of the prior art.

TABLE 3

| Hot rolled sheet annealing method | $B_{10}$(T) | $W_{15/50}$ (w/kg) | $W_{17/50}$ (w/kg) |
|---|---|---|---|
| (3) The method of this invention | 1.90 | 0.70 | 1.03 |
| (4) The method of this invention | 1.89 | 0.71 | 1.04 |
| (5) The method of the prior art | 1.87 | 0.81 | 1.16 |
| (6) The method of the prior art | 1.86 | 0.83 | 1.20 |

EXAMPLE 3

The same hot rolled sheet used in Example 2 was subjected to annealing under the following conditions (7) and (8).

(7) The method of this invention: the hot rolled sheet was heated to a temperature of 1080° C., held at this temperature for twenty seconds, then charged into a furnace where the temperature was 950° C. When the sheet temperature reached 950° C., immediately it was rapidly cooled.

(8) The method of the prior art: the hot rolled sheet was rapidly heated to 980° C., held at 980° C. for four minutes, and then immediately quickly cooled.

The sheets were then subjected to the treatment indicated in Table 4 to produce a sheet product 0.15 mm thick which had the magnetic property indicated in Table 5.

As is clear from Table 5, the sheet product manufactured by the method of the present invention has better magnetic property than the product obtained from the method of the prior art.

TABLE 4

| Pre-cold rolling | Intermediate annealing | Primary cold rolling | Intermediate annealing | Final cold rolling | Decarburizing annealing | Annealing separating agent | Finish annealing |
|---|---|---|---|---|---|---|---|
| thickness 2.3 mm ↓ thickness 1.25 mm | 980° C. × 2 min. | thickness 1.25 mm ↓ thickness 0.43 mm | 980° C. × 2 min. | thickness 0.43 mm ↓ thickness 0.15 mm | 850° C. × 150 sec. $H_2 + N_2$ wet | MgO | 1200° C. × 20 hr |

TABLE 5

| Hot rolled sheet annealing process | $B_{10}$(T) | $W_{13/50}$ (w/kg) | $W_{15/50}$ (w/kg) |
|---|---|---|---|
| (7) The method of this invention | 1.90 | 0.42 | 0.60 |
| (8) The method of the prior art | 1.86 | 0.47 | 0.70 |

EXAMPLE 4

Steel containing 0.050% C, 3.30% Si, 0.059% Mn, 0.004% P, 0.027% S, 0.17% Cu, and 0.010% Sb was prepared by a usual method of steel melting, continuous casting, and hot rolling to produce hot rolled sheet 2.3 mm thick. The hot rolled sheet was subjected to the same annealing procedure and treatment described in Example 3 to obtain a sheet product 0.15 mm thick having the magnetic property indicated in Table 6. As is clear from Table 6, the sheet product manufactured in accordance with the method of the present invention has better magnetic properties than the product of the prior art.

TABLE 6

| Hot rolled sheet annealing process | $B_{10}$(T) | $W_{13/50}$ (w/kg) | $W_{15/50}$ (w/kg) |
|---|---|---|---|
| (9) The method of this invention | 1.92 | 0.38 | 0.57 |
| (10) The method of the prior art | 1.87 | 0.46 | 0.67 |

EXAMPLE 5

Steel containing 0.045% C, 3.50% Si, 0.056% Mn, 0.005% P, 0.028% S, 0.15% Cu, 0.010% Sb, and 0.020% Se was prepared by a usual method of steel melting, continuous casting, and hot rolling to produce hot rolled sheet 2.3 mm thick which was then subjected to the same annealing process described in (3) and (4) of Example 3.

The sheet was then subjected to the same treatment indicated Table 1 and Table 4 to produce sheet products 0.30 mm and 0.15 mm thick, respectively. The sheets had the magnetic properties shown in Table 7.

As is clear from Table 7, the products manufactured by the method of the invention have better magnetic properties than the product of the prior art.

TABLE 7

| Hot rolled sheet annealing process | Sheet thickness (mm) | $B_{10}$(T) | $W_{13/50}$ (w/kg) | $W_{15/50}$ (w/kg) | $W_{17/50}$ (w/kg) |
|---|---|---|---|---|---|
| (11) method of this | 0.15 | 1.92 | 0.37 | 0.57 | — |
| invention | 0.30 | 1.93 | — | 0.69 | 1.01 |
| (12) method of the | 0.15 | 1.87 | 0.49 | 0.70 | — |
| prior art | 0.30 | 1.88 | — | 0.81 | 1.16 |

What is claimed is:

1. In a method for the production of a single oriented silicon steel strip which consists of a series of steps of providing a silicon steel slab consisting of 0.010 to 0.10% C, 2.5 to 4.5% Si, 0.02 to 0.15% Mn, a total amount of 0.008 to 0.080% S, Se or S and Se, the remainder being Fe and unavoidable impurities, hot rolling said silicon steel slab into strip, subjecting said hot rolled strip to hot strip annealing, subjecting said hot rolled and annealed strip to more than 2 cold rolling steps including an intermediate annealing between any two of said cold rolling steps, said final cold rolling being carried out with a reduction rate of 40 to about 65% to a specified strip thickness, and finally subjecting said cold rolled strip to decarburizing annealing and the final annealing, the improvement which consists of subjecting said hot rolled strip in said hot strip annealing procedure to a two-step annealing cycle in which the first step consists of heat soaking in a furnace at an elevated temperature range of 1000° to 1200° C., immediately followed by the second step which consists of heat soaking in a furnace at a low temperature range of 750° to 980° C., and said silicon steel strip being maintained at said first step elevated temperature range for a finite period of up to 300 seconds prior to transfer to said second step low temperature range, and finally said silicon steel strip being maintained at said low temperature range for a finite period for up to 600 seconds, and then being cooled to room temperature, the duration of said first and second steps being sufficient to improve the core loss value $W_{15/50}$ and magnetic flux density $B_{10}$ values of said steel strip.

* * * * *